US005564198A

United States Patent [19]

Kilpeläinen et al.

[11] Patent Number: 5,564,198

[45] Date of Patent: Oct. 15, 1996

[54] APPARATUS FOR SUPPLYING STEAM INTO A SILO

[75] Inventors: Reijo Kilpeläinen, Kitee; Risto Laukkanen; Matti Virolainen, both of Savonlinna, all of Finland

[73] Assignee: Andritz-Patentverwaltungs-Gesellschaft m.b.H., Graz, Austria

[21] Appl. No.: 193,476

[22] Filed: Feb. 8, 1994

[30] Foreign Application Priority Data

Feb. 11, 1993 [FI] Finland ..... FI930595

[51] Int. Cl.[6] ..... F26B 19/00

[52] U.S. Cl. ..... 34/233; 34/225; 34/582; 34/585

[58] Field of Search ..... 34/360, 389, 582, 34/585, 225, 233

[56] References Cited

U.S. PATENT DOCUMENTS

| | | | |
|---|---|---|---|
| 3,934,355 | 1/1976 | Weibull | 34/26 |
| 4,096,027 | 6/1978 | Sherman . | |
| 4,124,440 | 11/1978 | Sherman | 162/246 |
| 4,930,230 | 6/1990 | Weckherlen et al. | 34/168 |

FOREIGN PATENT DOCUMENTS

| | | |
|---|---|---|
| 1146788 | 5/1983 | Canada . |
| 0326012 | 2/1989 | European Pat. Off. . |
| 2549110 | 1/1985 | France . |

*Primary Examiner*—Henry A. Bennett
*Assistant Examiner*—Dinnatia Doster
*Attorney, Agent, or Firm*—Birch, Stewart, Kolasch & Birch, LLP

[57] ABSTRACT

An apparatus supplies steam into a silo via holes provided in the bottom (3) of the silo and via channels (8) provided below the silo. The steam supply channel (8) is provided with a feed connection through which the steam to be fed into the silo is passed into the steam supply channel (8). Furthermore, the channel (8) is provided with steam feed nozzles (17) placed under the holes in the bottom (3) of the silo. The nozzle (17) is preferably provided with a mounting flange (21) which is fastened to the lower part of the channel (8), making it easy to remove the nozzle (17).

17 Claims, 2 Drawing Sheets

APPARATUS FOR SUPPLYING STEAM INTO A SILO

FIELD OF THE INVENTION

The present invention relates to an apparatus for supplying steam into a silo through holes in the bottom of the silo.

DESCRIPTION OF BACKGROUND ART

In the pulp industry, the wood used as raw material is cut into chips as required for the production process. Besides external dimensions, the chips must be of the right quality with respect to other properties as well. The chips are conveyed into a steaming silo and from there, they are further conveyed to the pulping process. In the silo, the moisture of the chips is adjusted to a suitable level by supplying steam into the silo. At the same time, the air among the chips, which is detrimental to the pulping process, is removed.

In previously known technology, the steam is supplied to different parts of the silo through steam supply pipes. To ensure that all parts of the silo receive enough steam, the steam supply points must be distributed in different parts of the silo walls and bottom. Therefore, the piping contains several branching points and is a complex structure. The steam is fed into the silo through perforated plates mounted on the pipe ends at the supply points. These perforated plates are blocked at times by chips accumulating on them or by impurities entering with the steam. This applies especially to the steam supply points in the bottom of the silo. The cleaning and possible replacement of the piping and perforated plates is a time-consuming operation which generally makes it necessary to empty the silo.

SUMMARY OF THE INVENTION

The object of the present invention is to achieve a new and simple steam supplying apparatus which ensures a reliable supply of steam into the silo and is easy to maintain. To implement this, the invention is characterized by the steam supply channel being provided with a feed connection through which steam is to be supplied. Steam nozzles are provided on the steam supply channel and are placed under the holes formed in the bottom of the silo. The solution of the invention obviates the need to build a complex pipework under the silo as the steam supply pipes proper are terminated at the edge of the silo, where one or two feed connections are provided. The steam is passed to different parts of the silo bottom via hollow beams fixed to the bottom and preferably forming its supporting structure. The nozzles can be easily installed and replaced afterwards. The nozzles may be standard components which are reliably positioned in correct locations. Removing impurities from the nozzles and perforated plates communicating with the silo space is simple and possible even when the silo contains chips.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

In the following, the invention is described by the aid of one of its embodiments by referring to the drawings, drawings which are given by way of illustration only, and thus are not limitative of the present invention, and in which.

DETAILED DESCRIPTION OF THE PREFERRED EMBODIMENTS

Figure 1:
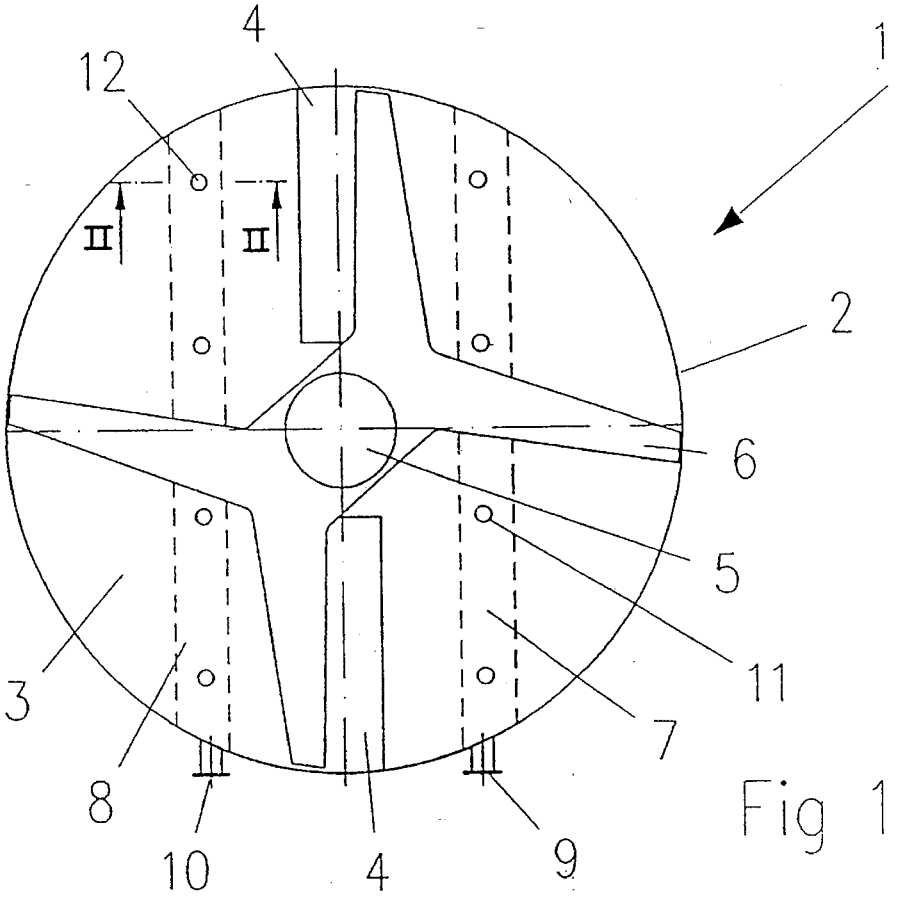
FIG. 1 presents the bottom of a silo in top view.
Figure 2:
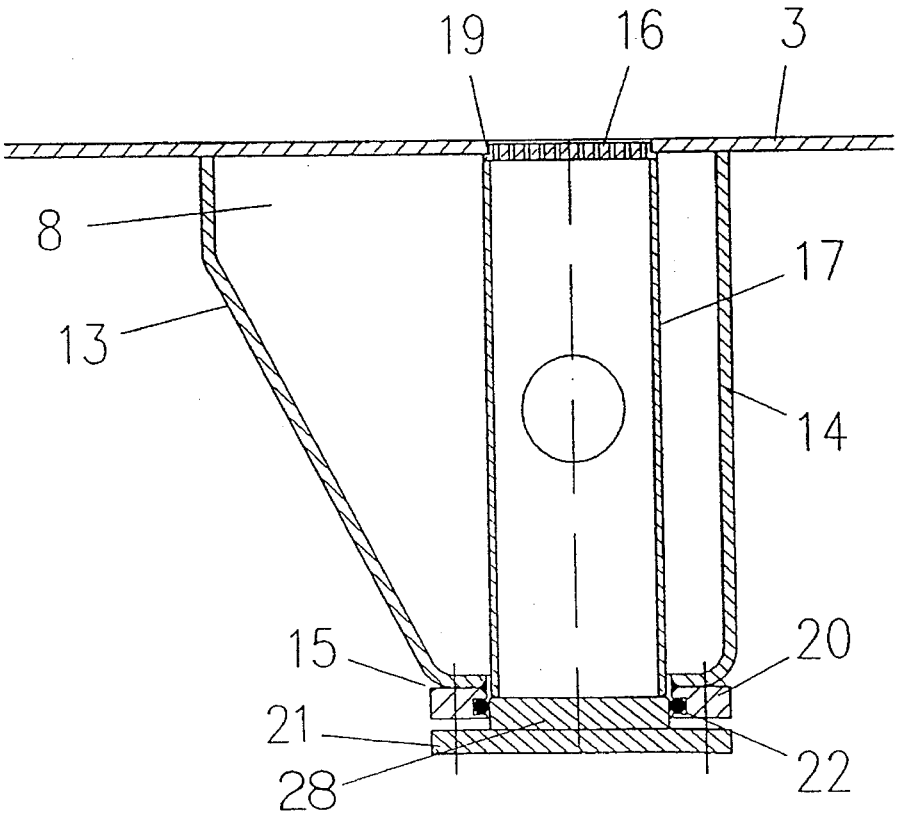
FIG. 2 presents a sectional view of a bottom channel.

FIG. 1 illustrates the structure of the bottom of the silo 1 as seen from above. The silo consists of a cylindrical wall 2 attached at its lower edge to a bottom plate 3 and at the upper edge to a top structure (not shown). The chips are supplied into the silo through the top part and removed through discharge openings 4 formed in the bottom 3. Mounted in the middle of the bottom plate is a discharger consisting of a discharger hub 5 supported by a bearing in the bottom plate and discharger arms 6 attached to the hub 5. The discharger is turned back and forth through an angle of about ±40° by means of an actuator (not shown). The four arms sweep the whole bottom of the silo, moving the chips towards the discharge openings 4. Mounted below the silo bottom are two hollow beams 7 and 8, the ends 9 and 10 of which are provided with junctions for the connection of steam supply pipes. The silo bottom 3 is provided with steam supply holes 11 and 12 placed along the hollow beams 7 and 8. FIG. 2 shows section II—II in FIG. 1, taken around hollow beam 8. Hollow beam 8, as well as the other hollow beam 7, consists of side walls 13 and 14 and a bottom side 15. The side walls are joined with the silo bottom 3, which forms the top side of the hollow beam. Hollow beam 8 serves as a common steam supply channel for several steam feed holes 12 formed in the bottom 3 of the silo. Inside the hollow beam 8, there is a tubular steam nozzle 17 mounted under each hole 12. One end of the nozzle extends up to the silo bottom and is provided with a perforated plate 16. The other end of the nozzle is provided with a closing plate, which also constitutes a mounting flange 21 and is attached to the tubular part of the nozzle e.g. by welding. The edge of the perforated plate and the edge 19 of the nozzle end as well as the lower edge of the hole in the silo bottom are so machined that the nozzle 17 is guided to the correct position and a sufficiently tight juncture is formed. The other end of the steam nozzle 17 extends to an opening provided in the bottom side 15 of the hollow beam. Welded to the bottom side of the hollow beam is a flange 20 with a hole in it of a size substantially equal to the opening, said flange being placed directly below said opening. The nozzle mounting flange 21 is attached to the underside of flange 20 e.g. with bolts, so the steam nozzle 17 is pressed against the underside of the silo bottom 3. In the interior surface of the hole in flange 20 is a seat for a sealing ring 22, which forms a joint between flange 20 and that part 28 of the mounting flange 21 which extends into the hole. Placed at about the middle of the nozzle 17 is a steam inlet opening 18, through which the steam flows from the channel 8 into the nozzle 17 and further through the perforated plate 16, i.e., grating into the silo.

Any rubbish and dirt that may enter the steam nozzle 17 during use will be gathered on the top surface of the mounting flange 21, from where they can be removed by loosening the fixing bolts and removing the nozzle. Similarly, a blocked or possibly a worn-out or damaged perforated plate can be replaced by loosening the bolts of the mounting flange and removing the steam nozzle 17 and the perforated plate 16 through the opening in the bottom side of the hollow beam. Positioning the replacement nozzle, as well as the original nozzle, is facilitated by the machined aligning surfaces in the nozzle and in the hole in the silo bottom.

Figure 3:
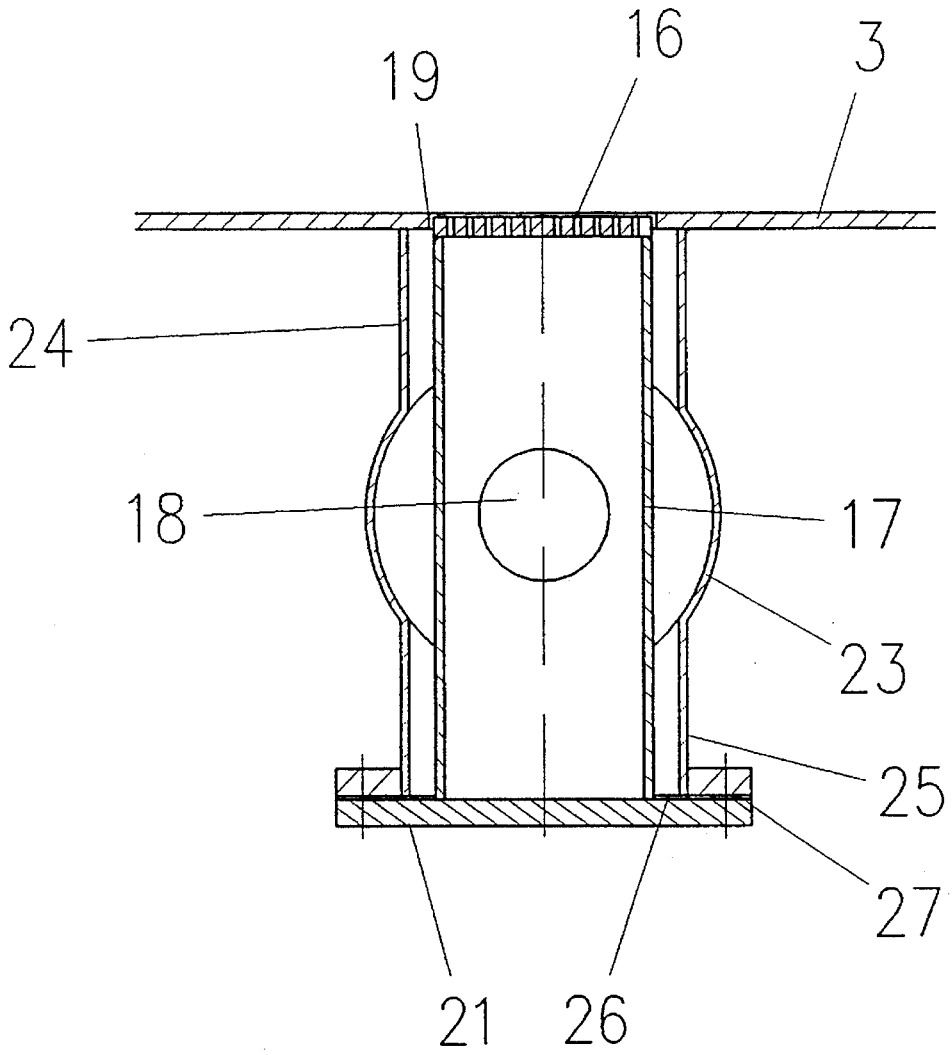
FIG. 3 presents a sectional view of another bottom channel.

FIG. 3 presents another embodiment of the apparatus of the invention for supplying steam into a silo. The steam supply channel is implemented as a tubular beam 23 laid below the silo bottom 3. One end of the tubular beam 23 is provided with steam feed connections for the supply of steam into it. In the locations below the holes 12 in the silo bottom, the tubular beam 23 is provided with brackets 24 extending to the silo bottom. Similarly, at corresponding points, the tubular beam 23 is provided with downward brackets 25, the lower edge of which forms the bottom side 26. Attached with bolts to the bottom side is a mounting flange 21, with a sealing 27 placed between the mounting flange 21 and the bottom side. The structure of the steam nozzle 17 and associated parts is substantially the same as in FIG. 2. In this case, too, the steam nozzle can be installed and serviced in a manner corresponding to that described in connection with FIG. 2.

The invention has been described above by the aid of some of its embodiments. However, the presentation is not to be regarded as limiting the invention, but instead the embodiments of the invention may vary within the limits defined by the claims.

We claim:

1. An apparatus for supplying steam into a silo, the silo having a bottom, holes being provided in the bottom of the silo for supply of steam to the silo, the apparatus comprising:

at least one steam supply channel placed below the bottom of the silo, the channel having a top side facing the bottom of the silo and a bottom side below the top side;

a feed connection through which steam to be supplied into the silo is passed into the steam supply channel;

steam nozzles provided in the steam supply channel, the steam nozzles being under the holes in the bottom of the silo each of the nozzles has a steam inlet hole connected to the steam supply channel, the steam inlet hole being located at a midsection of the nozzles; and a hollow beam supporting a plurality of said nozzles.

2. The apparatus according to claim 1, wherein each of the steam nozzles is a tubular body with one end extending to the bottom of the silo while another end extends substantially to the bottom side of the steam supply channel, a steam inlet hole is provided between ends of each of the steam nozzles, the steam inlet holes opening into the steam supply channel.

3. The apparatus according to claim 2, wherein the ends of the steam nozzles extending to the bottom of the silo are provided with a grating.

4. The apparatus according to claim 2, wherein the bottom side of the steam supply channel is provided with mounting holes for the steam nozzles, mounting flanges being detachably mounted in the mounting holes of the steam nozzles.

5. The apparatus according to claim 4, wherein the steam nozzles and the bottom of the silo are provided with aligning surfaces for guiding the nozzles into position, sealing elements being provided between the mounting flanges of the nozzles and the mounting holes in the bottom side of the steam supply channel.

6. The apparatus according to claim 1, wherein the nozzles are spaced from a center of the silo.

7. The apparatus according to claim 1, further comprising gratings provided on the steam nozzles.

8. The apparatus according to claim 7, wherein the nozzles are tubular.

9. The apparatus according to claim 1, wherein each of the nozzles has a steam inlet hole connected to the steam supply channel, the steam inlet hole being located at a midsection of the nozzles.

10. The apparatus according to claim 9, wherein the nozzles are tubular.

11. The apparatus according to claim 1, wherein the bottom of the silo is generally flat and the nozzles are located under the bottom of the silo.

12. The apparatus according 1, wherein the steam supply channel is a tubular beam laid below the bottom of the silo and further comprising brackets mounted beneath the holes in the silo bottom, the brackets being mounted to the silo bottom, the steam supply channel and the nozzles being held by the brackets.

13. The apparatus according to claim 12, wherein each of the steam nozzles is a tubular body and further comprising a mounting flange between each of the nozzles and the brackets and means for sealing the mounting flanges to the nozzles.

14. The apparatus according to claim 12, wherein each of the nozzles has a steam inlet hole connected to the steam supply channel, the stem inlet hole being located at a midsection of the nozzles.

15. The apparatus according to claim 12, further comprising gratings provided on the steam nozzles, the gratings being located adjacent the holes in the bottom of the silo.

16. The apparatus according to claim 1, wherein a plurality of steam supply channels are provided as the at least one steam supply channel, each of the steam supply channels having at least one nozzle provided therein.

17. The apparatus according to claim 1, wherein the at least one steam supply channel has a longitudinal axis and the nozzles have longitudinal axes, the longitudinal axis of the at least one steam supply channel being generally perpendicular of the longitudinal axes of the nozzles.

* * * * *